US011585122B2

(12) United States Patent
Meyer et al.

(10) Patent No.: US 11,585,122 B2
(45) Date of Patent: Feb. 21, 2023

(54) SHOOT BOLT FOR LIMITING MOVEMENT OF A FENESTRATION PANEL

(71) Applicant: JELD-WEN, Inc., Charlotte, NC (US)

(72) Inventors: Shane Meyer, Klamath Falls, OR (US); Chris Graetsch, Klamath Falls, OR (US); David Yagla, Klamath Falls, OR (US)

(73) Assignee: JELD-WEN, INC., Charlotte, NC (US)

( * ) Notice: Subject to any disclaimer, the term of this patent is extended or adjusted under 35 U.S.C. 154(b) by 250 days.

(21) Appl. No.: 16/721,715

(22) Filed: Dec. 19, 2019

(65) Prior Publication Data

US 2020/0199912 A1 Jun. 25, 2020

Related U.S. Application Data

(60) Provisional application No. 62/781,787, filed on Dec. 19, 2018.

(51) Int. Cl.
*E05B 65/08* (2006.01)
*E05C 9/22* (2006.01)
(Continued)

(52) U.S. Cl.
CPC ..... *E05B 65/0864* (2013.01); *E05C 1/04* (2013.01); *E05C 7/045* (2013.01); *E05C 9/185* (2013.01); *E05C 9/22* (2013.01)

(58) Field of Classification Search
CPC ..... E05B 65/0864; E05B 65/087; E05B 65/0876; E05B 65/08; E05B 2065/0805; E05B 9/00; E05B 9/006; E05B 9/008; E05B 9/02; E05B 9/021; E05B 9/023; E05B 9/025; E05B 9/026; E05B 9/028; E05C 1/04; E05C 7/045; E05C 9/185; E05C 9/22; E05C 1/00; E05C 1/004; E05C 1/006;
(Continued)

(56) References Cited

U.S. PATENT DOCUMENTS 4,208,838 A * 6/1980 Kleine ..... E05D 15/5208 49/192
4,739,583 A * 4/1988 Tonsmann ..... E05F 7/08 49/192
(Continued)

FOREIGN PATENT DOCUMENTS

AT 505580 A2 * 2/2009 ..... E05B 17/2088
CH 660051 A5 * 3/1987 ..... E05C 9/24
(Continued)

*Primary Examiner* — Kristina R Fulton
*Assistant Examiner* — Tal Saif
(74) *Attorney, Agent, or Firm* — Lorenz & Kopf, LLP

(57) ABSTRACT

A shootbolt system for a fenestration assembly, such as a sliding patio door system, includes a chassis mountable to a stile of a sliding panel of the fenestration assembly, and a shootbolt slidably coupled to the chassis. The shootbolt is designed to be coupled to a corner drive system of the sliding panel for movement therewith upwardly or downwardly along the stile in response to an applied actuation force, such as from an operator handle. When extended, the shootbolt engages a receiver or stop mounted to the frame to prevent the sliding panel from rebounding when an adjacent second sliding panel is slidably moved to a closed position in contact with the sliding panel.

20 Claims, 7 Drawing Sheets

(51) Int. Cl.
*E05C 9/18* (2006.01)
*E05C 7/04* (2006.01)
*E05C 1/04* (2006.01)

(58) Field of Classification Search
CPC ..... E05C 1/02; E05C 1/06; E05C 7/04; E05C 9/00; E05C 9/006; E05C 9/02; E05C 9/025; E05C 9/18; E05C 9/1825; E05C 9/1833; E05C 9/1841; E05C 2009/1866; E05C 7/00; Y10T 292/0834; Y10T 292/0838; Y10T 292/0841; Y10T 292/0844; Y10T 292/0845; Y10T 292/1017; Y10T 292/102; Y10T 292/0969; Y10S 292/15; Y10S 292/16; Y10S 292/20; Y10S 292/21; Y10S 292/36; Y10S 292/38; Y10S 292/46; Y10S 292/51; Y10S 292/53; Y10S 292/47; E05D 15/06; E06B 3/487; E06B 3/46
See application file for complete search history.

(56) References Cited

U.S. PATENT DOCUMENTS 5,290,077 A 3/1994 Fleming
6,176,041 B1 1/2001 Roberts
6,497,072 B2 * 12/2002 Fries ..... E05B 65/08 49/213
6,691,462 B2 * 2/2004 Oestermann ..... E05D 15/1042 49/213
7,275,773 B1 * 10/2007 Weathersby ..... E05B 63/06 292/DIG. 60
2006/0150516 A1 * 7/2006 Hagemeyer ..... E05C 7/04 49/366
2008/0302017 A1 * 12/2008 Phillips ..... E05C 1/06 292/137
2009/0295173 A1 * 12/2009 Heid ..... E05B 63/06 292/340
2011/0126465 A1 * 6/2011 Bai ..... E05D 15/52 49/260
2012/0049540 A1 * 3/2012 Taylor ..... E05C 9/22 292/157
2019/0203521 A1 * 7/2019 Massey ..... E05C 9/04

FOREIGN PATENT DOCUMENTS

CN 101089349 A * 12/2007 ..... E05C 9/006
CN 102828670 A * 12/2012
CN 104975794 A * 10/2015
CN 105909155 A * 8/2016 ..... E05B 3/00
CN 107130872 B * 7/2018 ..... E05F 7/08
DE 2353616 A1 5/1975
DE 3242090 A1 6/1983
DE 202007011699 U1 * 11/2007 ..... E05C 9/1808
DE 202007011699 U * 12/2007 ..... E05D 15/10
DE 202007011699 U1 * 12/2007 ..... E05C 7/04
DE 202009007430 U1 * 11/2010 ..... E05C 7/04
EP 493689 A1 * 7/1992 ..... E05C 9/24
EP 1298271 A2 4/2003
EP 1496183 A2 1/2005
EP 2829679 A1 * 1/2015 ..... E05B 17/0025
EP 3266969 A2 * 1/2018 ..... E05C 9/006
FR 2316421 A1 1/1977
FR 2852051 A1 * 9/2004 ..... E05C 1/04
GB 2439212 A * 12/2007 ..... E05B 17/2088
GB 2554725 A * 4/2018 ..... E05C 9/22
WO WO-9409236 A1 * 4/1994 ..... E05B 17/2057
WO WO-2007075075 A1 * 7/2007 ..... E05D 15/10
WO WO-2009154343 A1 * 12/2009 ..... E05C 9/066
WO WO-2013004981 A1 * 1/2013 ..... E05C 9/002
WO WO-2017147983 A1 * 9/2017 ..... E06B 3/50
WO WO-2019211147 A1 * 11/2019 ..... E05B 65/087

* cited by examiner

SHOOT BOLT FOR LIMITING MOVEMENT OF A FENESTRATION PANEL

RELATED APPLICATIONS

This application claims the benefit under 35 U.S.C. § 119(e) from U.S. Provisional Patent Application No. 62/781,787, filed Dec. 19, 2018, which is incorporated herein by reference.

BACKGROUND

Fenestration panels may include window panels, door panels, and non-moving "fixed" panels installed into frames. The panels and frames may be provided individually or as a package, either pre-assembled or as a kit to be assembled on site, or the frames may be custom built. A fenestration system may include seals between the panel and the frame providing an environmental barrier. Some panels are movable, such as a sliding window or door. Other panels may be fixed to the frame so they cannot move relative to the frame. Panels may be large and heavy, sometimes weighing hundreds of pounds. Opening and closing the panel or otherwise moving the panel within a frame may be difficult and awkward. Some panels may ride on wheels to reduce the effort required for sliding movement. However, the mass of the panel may still require significant effort to start and stop movement of the panel. Some fenestration systems may have multiple sliding panels in which case two or more panels may be moved toward each other to a closed position where the two panels are latched together. In some instances, the forces required to draw two heavy sliding panels together may be ergonomically sub-optimal. Additionally, the user may need to actuate latching mechanisms while exerting forces on both panels to bring the panels together, which may further add awkwardness and difficulty. The present inventors have recognized that in some instances, the mass of the panels, and the relatively low friction provided by wheels, may cause the panels to rebound off each other upon contact when closing, causing the panels to separate.

The present inventor has thus envisioned a benefit of preventing movement of one panel away from a closed position while the other panel is being moved into the closed position. The present inventor has also recognized a need for retrofitting existing panel and latching systems to provide such benefits to existing fenestration systems.

Additional aspects and advantages will be apparent from the following detailed description of preferred embodiments, which proceeds with reference to the accompanying drawings.

DETAILED DESCRIPTION OF PREFERRED EMBODIMENTS

Figure 1:
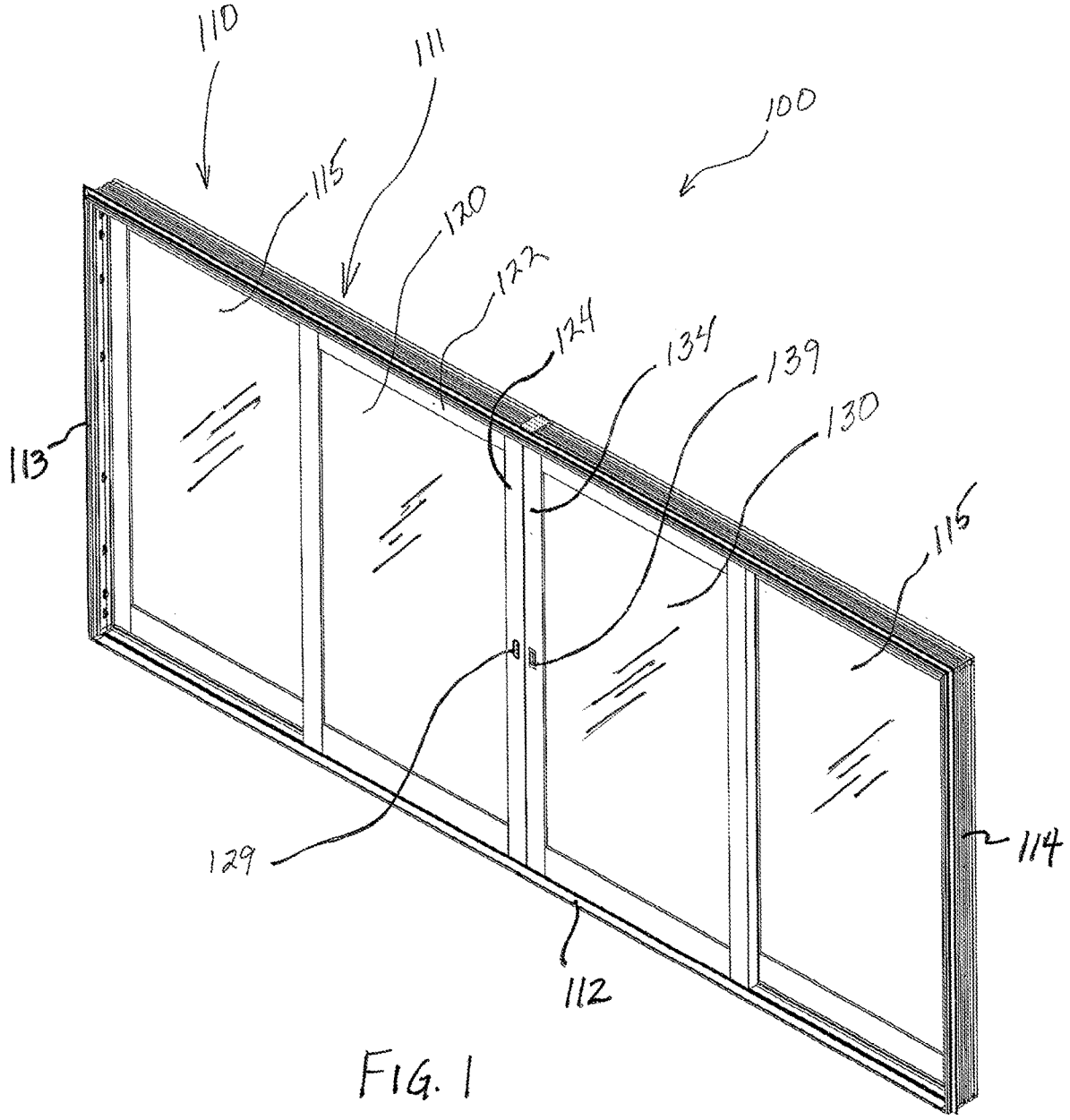
FIG. 1 is an isometric view of a fenestration panel system.

FIG. 1 illustrates an embodiment of a fenestration system in the form of a sliding or gliding door panel assembly 100 (also referred to herein as panel assembly 100 or fenestration panel assembly 100) including components thereof. The door panel assembly 100 includes a frame 110 having a header 111, a sill 112, and vertical jambs 113, 114. A first panel 120 and a second panel 130 are disposed within and slidably coupled to the frame 110. The first panel 120 and the second panel 130 may move within the frame 110 in a direction parallel to the frame 110. The panel assembly 100 also includes fixed panels 115 fixedly attached to the frame 110 adjacent the vertical jambs 113, 114. The first panel 120 includes a first handle 129 that may be used to grip the first panel 120 for sliding it between open and closed positions, and articulated (e.g., by rotating the handle 129) to actuate latching or securement mechanisms of the first panel 120, which mechanisms cause the first panel 120 to be moved slightly toward a fixation point where the first panel 120 is secured to the frame 110 and/or to the adjacent fixed panel 115, for example. The first handle 129 may be used to dispose the first panel 120 in at least an unlocked configuration and a locked configuration. Similarly, the second panel 130 includes a second handle 139 that may be used to grip the second panel 130 for movement in the plane of the panels and articulated to actuate latching mechanisms of the second panel 130, which mechanisms may latch the second panel 130 to the first panel 120, secure the second panel 130 to the frame 110, or otherwise selectively secure the position of the second panel 130. The second handle 139 may be used to dispose the second panel 130 in at least an unlocked configuration and a locked configuration. The first panel 120 and the second panel 130 are illustrated in FIG. 1 in a closed position such that a right stile 124 of the first panel 120 is adjacent or abutting a left stile 134 of the second panel 130.

Figure 2:
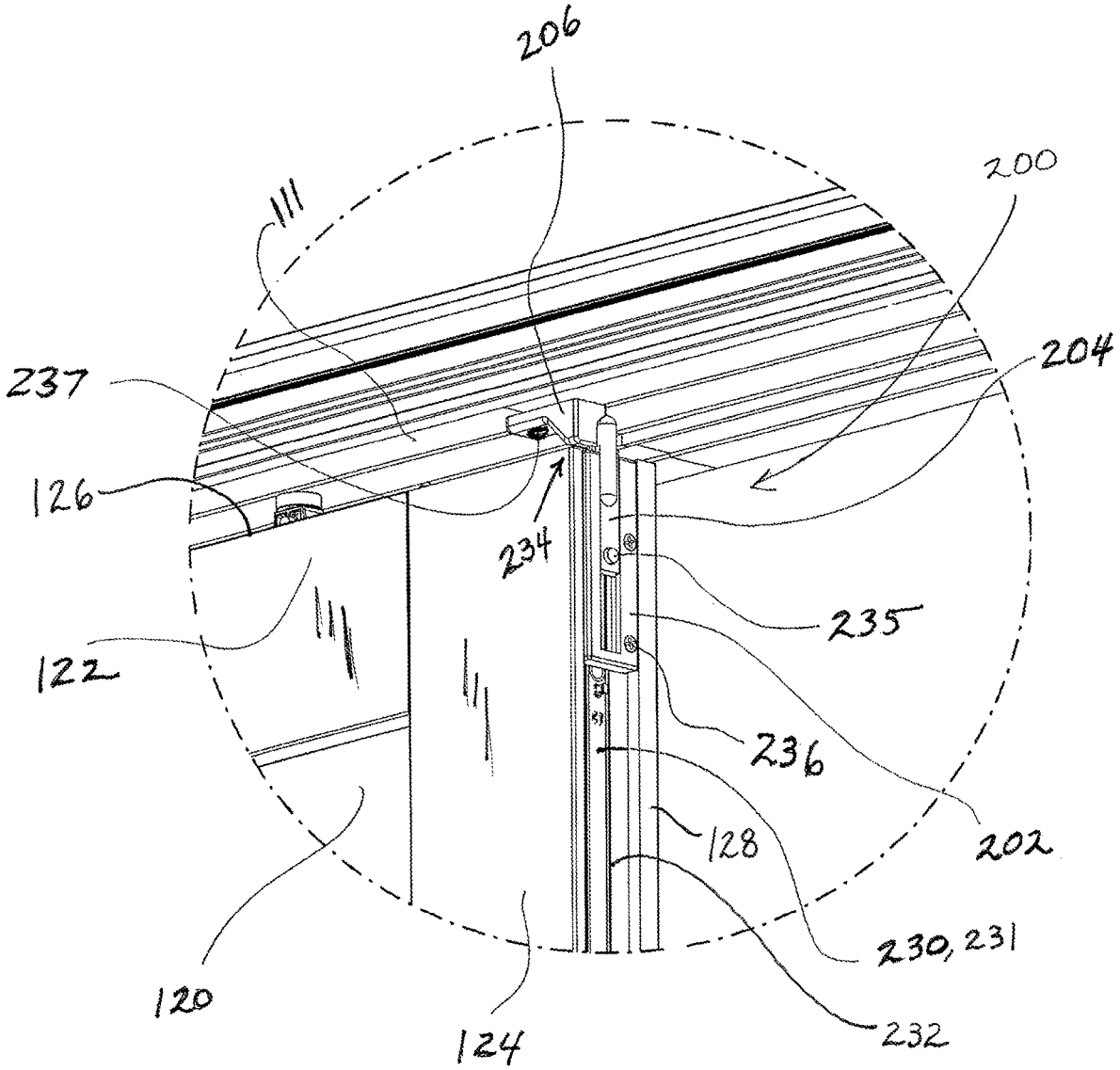
FIG. 2 is an isometric detail view of the fenestration panel system of FIG. 1, showing an upper right corner of a left-hand sliding door panel, as viewed from a bottom-right perspective, with a right-hand sliding door panel (not shown in FIG. 2) removed or moved to an open position to reveal detail of a shoot bolt system of a first embodiment shown in an extended (engaged) position.

FIG. 2 is a detail view of a portion of the fenestration system 100 of FIG. 1 with the second panel 130 (not shown) moved to the open position, out of view. A top right corner of the first panel 120 includes a top rail 122 connected to the right stile 124. The first panel 120 is movably mounted within the frame 110 with the top rail 122 positioned adjacent the horizontal header 111 of frame 110, and with an outer edge 126 of the top rail 122 facing toward the header 111. The first panel 120 includes a corner drive mechanism 230. In the illustrated embodiment, the corner drive mechanism 230 includes a flexible band 231 in slidable engagement within a track 232 extending along at least a portion of a perimeter of the first panel 120. In the illustrated embodiment, the track 232 and flexible band 231 of the corner drive mechanism 230 extend along the outer edge 126 of the top rail 122 and an outer edge 128 of the right stile 124, and around a corner 234 near where the top rail 122 and right stile 124 meet and are joined together to form the corner 234. Thus, a first portion of the flexible band 231 extends along the right stile 124 and is movable upwardly and/or downwardly in response to an actuation force, which may be applied via handle 129 (FIG. 1), and a second portion of the flexible band 231 extends along the top rail 122 and is operably linked to the first portion of the band 231 so the second portion is moved horizontally in response to movement of the first portion upwardly or downwardly along the right stile 124. The band 231 may be a metal band operably coupled to the first handle 129 (FIG. 1) via a linkage such as a gear (not shown) such that manipulation of the first handle 129 applies an actuation force that drives the band 231 to displace within and along the track 232 such that the band 231 moves vertically along the right stile 124 and horizontally along the top of the top rail 122. In some embodiments, the band 231 may be operably coupled to and engage one or more mechanisms (not shown) disposed along the perimeter of the first panel 120. The mechanisms may facilitate various functions, for example latching the first panel 120 to the second panel 130, adjusting the position of the first panel 120 in at least one direction, for example to seat the first panel 120 against the frame 110 (FIG. 1) or the fixed panel 115 (FIG. 1), lifting the panel off the sill of the frame, or releasing a portion of the panel from the frame to allow the panel to be rotated relative to the frame. In the illustrated embodiment, manipulation of the first handle 129 causes the band 231 to travel back and forth along the track 232 between at least a first band position and a second band position.

In other embodiments (not shown), the corner drive mechanism 230 may comprise an interconnected assembly, set, or series of sliding and rotating link arms extending around the corner 234, such as a 2-bar or 3-bar linkage, or various other mechanisms, as are known in the art. The band 231 (or a vertical link arm in other embodiments) may be disposed in the first position when the first panel 120 is disposed in the unlocked configuration, and may be disposed in the second position when the first panel 120 is disposed in the locked configuration. As such, manipulation of the first handle 129 causes a portion of the band 231 (or other linkage) extending along the outer edge of the right stile 124 to travel up from the first or unlocked position to the second or locked position and down from the second or locked position to the first or unlocked position. The band 231 may include one or more engagement features coupled to the band 231 or other linkage of the corner drive mechanism 230. In the illustrated embodiment, the engagement features include a protrusion or pin 235 extending laterally from the band 231 and sized and positioned to engage a shoot bolt system 200 described below. The pin 235 is translated between a first pin position and a second pin position when the band 231 or linkage translates between the first position and the second position.

In the illustrated embodiment, the fenestration panel system 100 includes a shoot bolt system 200. In the illustrated embodiment, the shoot bolt system 200 may limit travel of the first panel 120 relative to the frame 110 when the first panel 120 is disposed in the locked configuration. The shoot bolt system 200 may include a chassis 202, a shootbolt 204 (or "slider"), and a receiver 206 that may comprise a stop or keeper. The chassis 202 may be fixedly attached to the right stile 124 and/or the top rail 122. The receiver 206 may be fixedly attached to the header 111 of the frame 110. The shootbolt 204 is slidably coupled to the chassis 202 and positionable between a retracted position (illustrated in FIG. 3) and an extended latching position (illustrated in FIG. 2). The shootbolt 204 is coupled to the band 231 via pin 235 so as to facilitate co-movement of the shootbolt 204 and the band 231 of the corner drive mechanism 230. Hence, the shootbolt 204 may be operably coupled to the first handle 129 via the corner drive mechanism 230 such that when the first panel 120 is disposed in the unlocked configuration, the shootbolt 204 is disposed in the retracted position, wherein the shootbolt 204 is recessed in the chassis 202; and when the first panel 120 is disposed in the locked configuration, the shootbolt 204 is disposed in the extended position, wherein an extended portion 450 (FIG. 4) of the shoot bolt projects vertically past the end of the chassis 202 and the right stile 124, and above the top rail 122. In other embodiments, the shoot bolt system 200 may be attached to and limit travel of a panel other than the first panel 120, for example the second panel 130. Similarly, the shoot bolt system 200 may be attached to the first panel 120 at any other corner of the first panel 120, such as at a bottom corner of the first panel 120 along the bottom of the right stile 124, or within any stile or rail of the first panel 120. And in some embodiments (not illustrated), the shoot bolt system 200 may include more than one shoot bolt, such as a first shoot bolt attached to a top of the right stile 124 and a second shoot bolt attached to a bottom of the right stile 124, moving in opposite directions in response to manipulation of the first handle 129.

As stated above, the receiver 206 (illustrated in the form of a stop) is fixedly attached to the header 111 of the frame 110 via at least one threaded fastener 237, for example a wood screw. The shape of the receiver 206 and its position on the header 111 facilitate engagement of the receiver 206 with the shootbolt 204 when the shootbolt is in the extended position as shown in FIG. 2, so as to provide a stop to limit movement of the first panel 120 relative to the frame 110 in at least one direction. In some embodiments, the panel system 100 may include more than one receiver 206 coupled to the header 111, establishing stops at additional locations along the sliding travel distance of the first panel 120. In the illustrated embodiment, the receiver 206 is positioned to prevent movement of the first panel 120 away from the closed position. As such, the first panel 120 is prevented from being moved away from the closed position when the second panel 130 is moved into the closed position. More specifically, the first panel 120 is held in the closed position by the shoot bolt system 200 if and/or when the second panel 130 contacts the first panel 120, thereby preventing the first panel 120 from rebounding off the second panel 130 upon contact.

Figure 3:
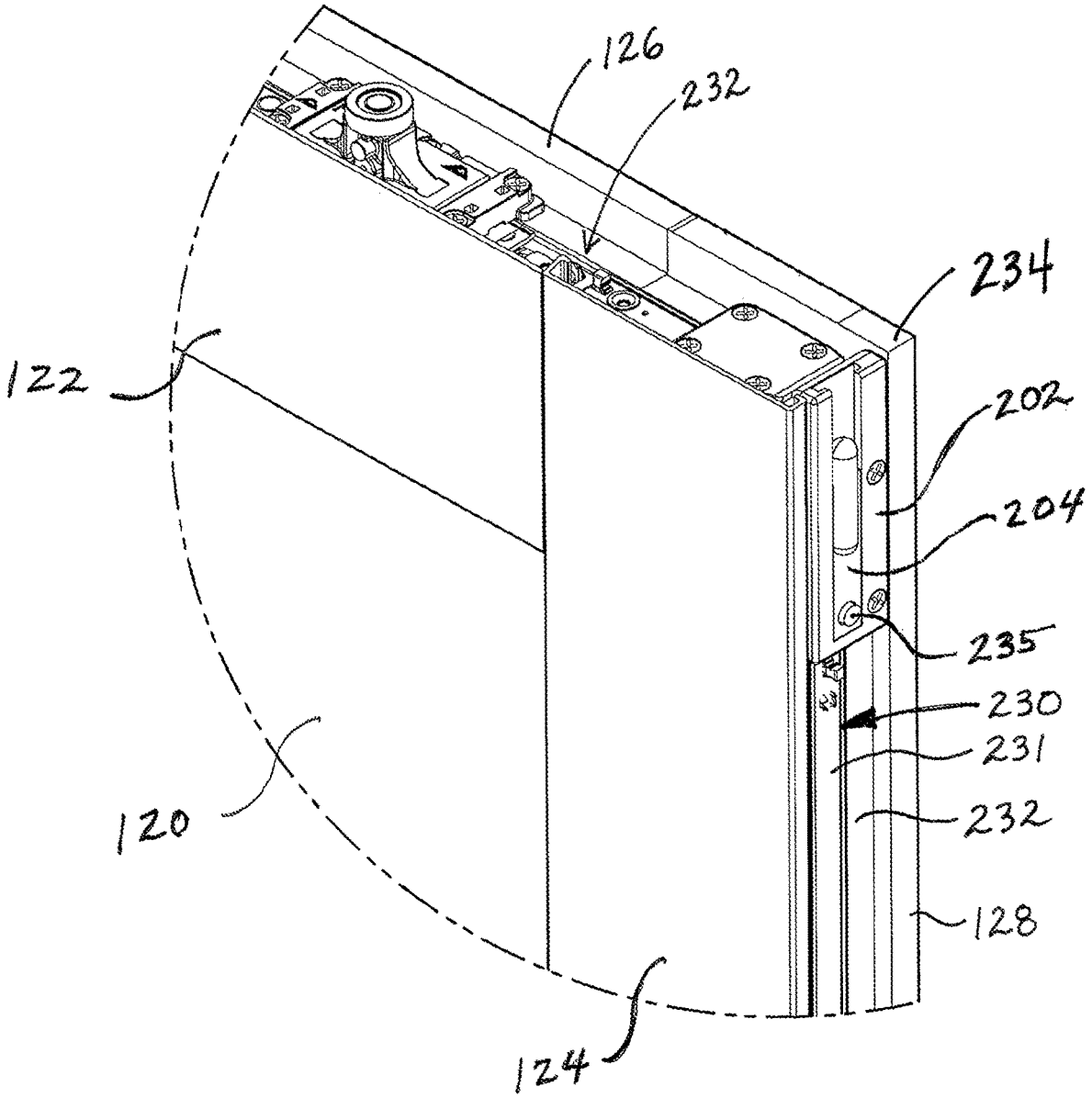
FIG. 3 is an isometric detail view of an upper corner of the left-hand door panel of FIG. 2, showing the shoot bolt system disposed in a retracted (disengaged) position.

FIG. 3 is an isometric detail view of the upper right corner of the first panel 120, with the frame 110 omitted for clarity, and with the shootbolt 204 disposed in the retracted position consistent with the first panel 120 being in the unlocked configuration. As shown in FIG. 3, the shootbolt 204 is displaced away from the receiver 206 (FIG. 2) so as to avoid engagement of the shootbolt 204 with the receiver 206 when the first panel 120 is moved into and out of the closed position. The chassis 202 is shown coupled to the right stile 124 and the top rail 122. The pin 235 is shown engaging a hole or aperture 446 (FIG. 4) in the shootbolt 204.

Figure 4:
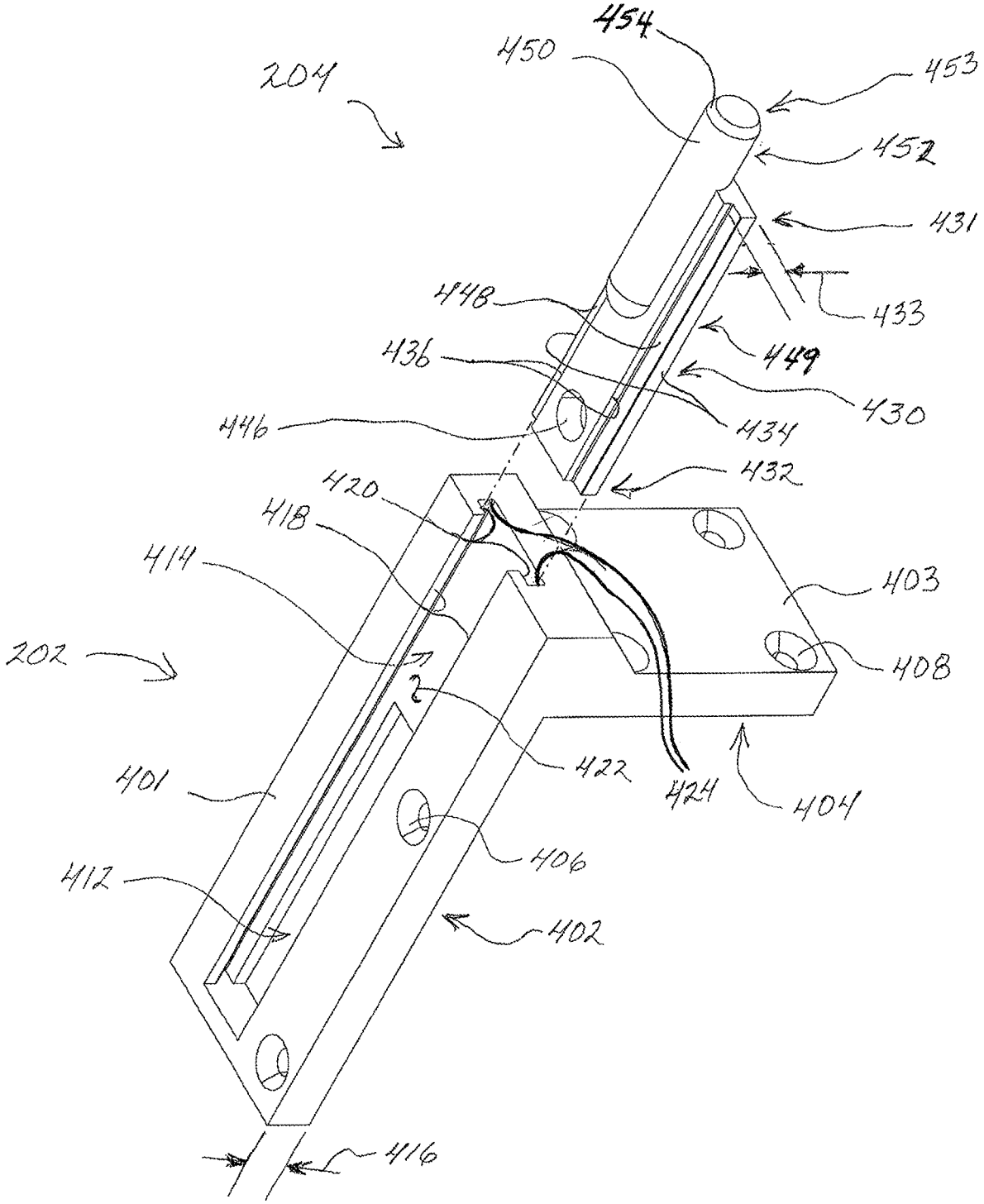
FIG. 4 is an isometric view of the shoot bolt system of FIG. 3 with details of the door panel omitted.

FIG. 4 illustrates the chassis 202 and the shootbolt 204 of the shoot bolt system 200 (FIG. 2) in an isometric exploded view. As shown, the chassis 202 comprises a guideway 414 disposed longitudinally along a vertical section 401 and configured to receive the shootbolt 204. As stated above, the chassis 202 may be fixedly attached to the right stile 124. As such, the chassis 202 includes a vertical section 401 having a vertical mounting surface 402. The vertical section 401 includes one or more vertical section mounting holes 406 to facilitate attachment of the vertical section 401 to the right stile 124. The vertical section mounting holes 406 may be located on one or both sides of the guideway 414. In the illustrated embodiment, the vertical section mounting holes 406 are disposed on only one side of the vertical section 401.

In some embodiments, the vertical section mounting holes 406 may be countersunk. The vertical section 401 may have a vertical section thickness 416 sized to prevent contact between the vertical section 401 and the second panel 130 (or any portion thereof) when the first panel 120 and the second panel 130 are disposed in the closed position. The vertical section thickness 416 may be between 5 mm and 14 mm, between 7 mm and 12 mm, between 9 mm and 11 mm, or between 9.5 mm and 10.5 mm.

The chassis 202 further includes a horizontal section 403 or mounting flange coupled to the vertical section 401. The horizontal section 403 includes a horizontal mounting surface 404. The horizontal mounting surface 404 may be perpendicular to the vertical mounting surface 402 of the vertical section 401. The horizontal section 403 includes one or more horizontal section mounting holes 408 to facilitate attachment of the horizontal section 403 to the top rail 122. The horizontal section mounting holes 408 may be countersunk. The horizontal section 403 may include one, two, three, four, or more horizontal section mounting holes 408. In some embodiments, the horizontal section 403 may be coupled to the vertical section 401 at an end of the vertical section 401, and in other embodiments, the horizontal section 403 may be coupled to the vertical section 401 at a position disposed inward from an end of vertical section 401 so that a portion of the vertical section 401 and a portion of the guideway 414 extend beyond the horizontal section 403.

The guideway 414 is sized and shaped to slidably receive the shootbolt 204 and defines a pathway for movement of the shootbolt 204. In the illustrated embodiment, the guideway 414 is disposed offset to one side of the chassis 202. The vertical section 401 may include an elongate opening 412 disposed at least partially along the guideway 414 to allow the pin 235 (FIGS. 2, 3, and 6) to extend laterally through the vertical section 401 and allow the pin 235 to translate vertically within the elongate opening 412 between the first pin position and the second pin position. Guideway 414 may be formed as a T-slot (having T-shaped cross section, as shown), dovetail slot, or other undercut opening or slot, or hole, and is sized to receive the shootbolt 204 to allow shootbolt 204 to freely slide therealong. In the illustrated T-slot embodiment, the guideway 414 includes parallel inward facing first surfaces 418 and parallel inward facing second surfaces 420. The parallel inward facing second surfaces 420 may be spaced apart by a distance greater than spacing between parallel inward facing first surfaces 418.

The shootbolt 204 may include a flat section 430 having a first end 431 and a second end 432. The flat section 430 includes first parallel outward facing surfaces 434 that may define a width of the shootbolt 204. The first parallel outward facing surfaces 434 may be spaced apart to facilitate sliding engagement with the inward facing second surfaces 420 of the guideway 414. The flat section 430 may also include second parallel outward facing surfaces 436. The second parallel outward facing surfaces 436 may be spaced apart to facilitate sliding engagement with the inward facing first surfaces 418 of the guideway 414.

The flat section 430 may also include second planar surfaces 448 disposed parallel to a second back surface 449. The second planar surfaces 448 may be disposed offset from the second back surface 449 to facilitate sliding engagement with the first planar surfaces 424 and the first back surface 422 of the guideway 414. The flat section 430 may include an aperture or hole 446 extending into or through the flat section 430 to facilitate engagement with the band 231 or more specifically engagement with the pin 235. The aperture or hole 446, which may be a blind hole, may be disposed adjacent the second end 432.

The shootbolt 204 may include an extended portion 450 extending longitudinally away from the first end 431. The extended portion 450 may extend sufficiently to engage the receiver 206 (FIG. 2) when the shootbolt 204 is disposed in the extended position. In the illustrated embodiment, the extended portion 450 is disposed offset to one side of the shootbolt 204. The extended portion 450 includes a first stop surface 452 adjacent the second back surface 449. The first stop surface 452 may include flat and non-flat portions. In some embodiments, the first stop surface 452 may include at least one convex portion. In some embodiments, the extended portion 450 may be cylindrical and may be a cylindrical rod or pin coupled to the flat section 430.

The extended portion 450 may include a bolt contact surface 454. The bolt contact surface 454 may be a chamfer or corner radius disposed at an end 453 of the extended portion 450. In some embodiments, the bolt contact surface 454 may extend around a perimeter of the extended portion 450. The bolt contact surface 454 may contact the receiver 206 as the first panel 120 approaches the closed position and prevent movement of the first panel 120 into the closed position.

Figure 5:
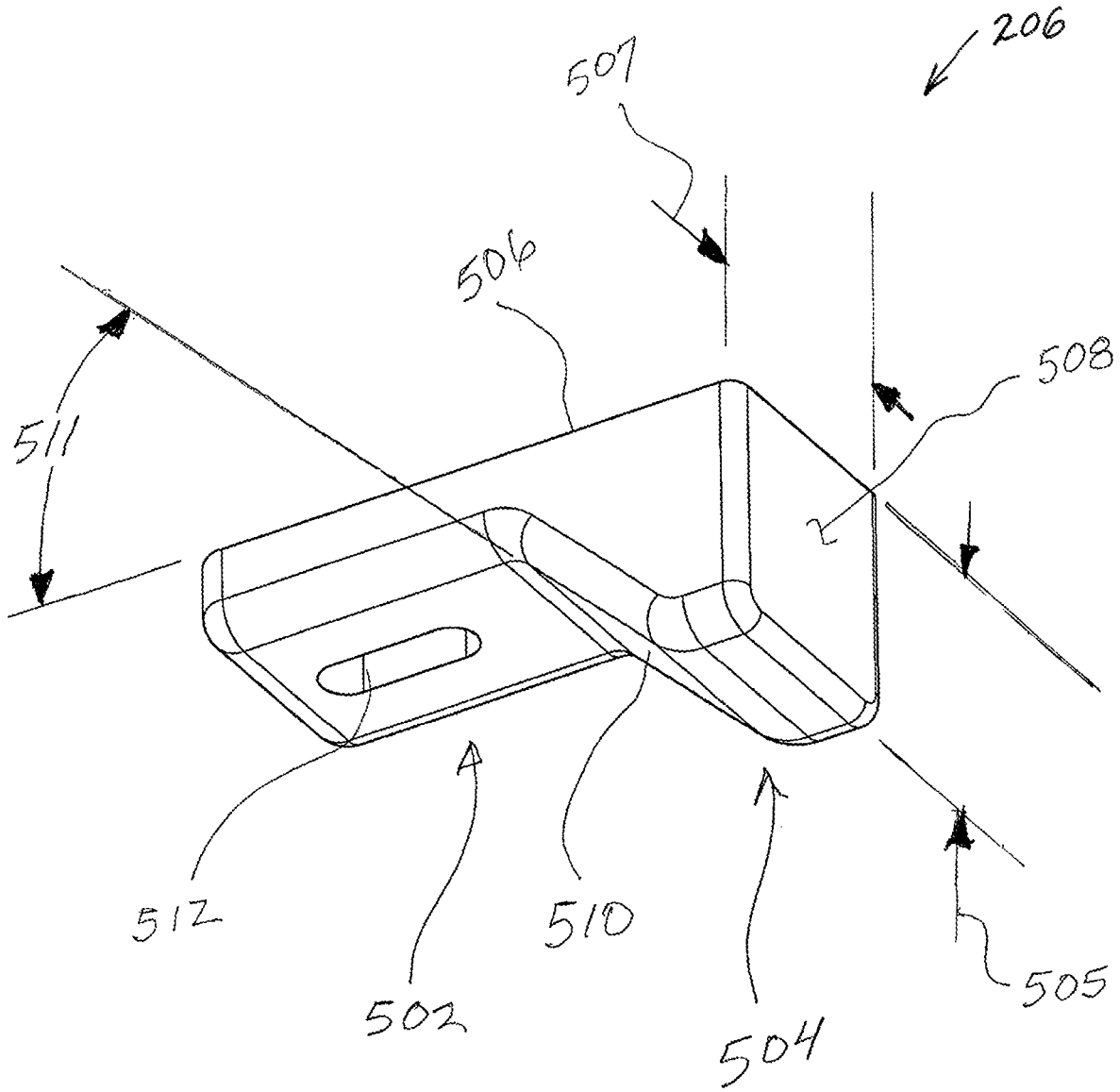
FIG. 5 is an isometric view of a receiver or stop of the shoot bolt system of FIG. 4.

Turning now to FIG. 5, the receiver 206 includes a receiver mounting section 502 and a raised portion 504. The receiver mounting section 502 extends away from a receiver mounting surface 506. The receiver mounting section 502 includes one or more fastener holes 512 extending through the receiver mounting section 502 and the receiver mounting surface 506. The one or more fastener holes 512 may be sized to receive threaded fasteners (not shown) therethrough to facilitate mounting of the receiver 206 to the header 111 or sill 112 of frame 110 (FIGS. 1-2). At least one fastener hole 512 may be a slot positioned along a longitudinal axis of the receiver 206.

The raised portion 504 extends away from the receiver mounting surface 506 by a receiver height 505. The receiver height 505 is sized to facilitate engagement of the extended portion 450 when the shootbolt 204 is disposed in the extended position. The first receiver contact surface 508 may also include a width 507 sufficient to accommodate a transverse movement of the extended portion 450 across the first receiver contact surface 508 if and/or when the first panel 120 is moved in the transverse direction due to manipulation of the first handle 129.

The raised portion 504 may also include a second receiver contact surface 510 to engage the extended portion 450 of the shootbolt 204. The second receiver contact surface 510 may slope away from the receiver mounting section 502 and toward the first receiver contact surface 508 at an angle 511 with respect to the receiver mounting surface 506. When mounted to the header 111, the second receiver contact surface 510 may be positioned and oriented to engage the bolt contact surface 454 of the extended portion 450 when the shootbolt 204 is at least partially disposed toward the second position and the first panel 120 is moved toward the closed position. The angle 511 may be sized to urge the shootbolt 204 toward the first position upon engagement of the second receiver contact surface 510. In some embodiments, the bolt contact surface 454 may slidably contact the second receiver contact surface 510 as the first panel 120 approaches the closed position. In an instance where the shootbolt 204 is at least partially disposed toward the extended position when the first panel 120 is moved into the closed position, the bolt contact surface 454 may slide on the second receiver contact surface 510, moving the shootbolt 204 toward the retracted position and allowing movement of the first panel 120 into the closed position.

Figure 6:
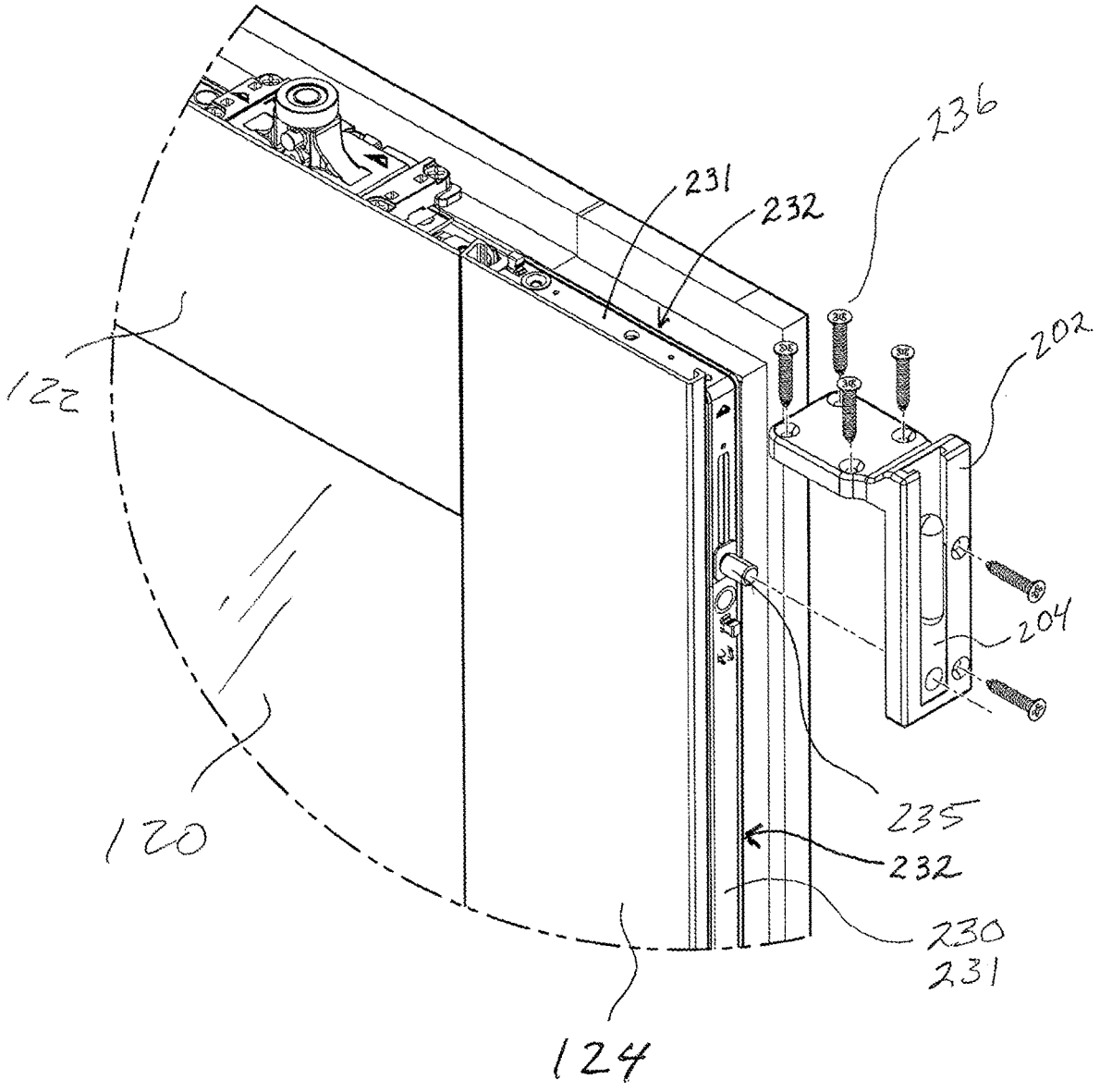
FIG. 6 is an exploded assembly view of the panel and shoot bolt system of FIG. 3.

FIG. 6 is an exploded isometric view showing the chassis 202 and the shootbolt 204 separated from the first panel 120. In some instances, the first panel 120 may have been manufactured without a shoot bolt system 200, as such the shoot bolt system 200 may be retrofitted onto the first panel 120. In some instances, the first panel 120 may require removal and/or modification of some portions of the first panel 120 prior to installing the shoot bolt system 200. In some instances, another mechanism, for example a latch (not shown), may be disposed at the installation location of the shoot bolt system 200 or more specifically in the location of the chassis 202 and the shootbolt 204. Hence, the installation process of the shoot bolt system 200 may require removal and/or modification of at least a portion of the other mechanism. In some embodiments, the other mechanism may be operably coupled to the first handle 129, or more specifically the mechanism may engage the band 231 of the corner drive mechanism 230.

Figure 7:
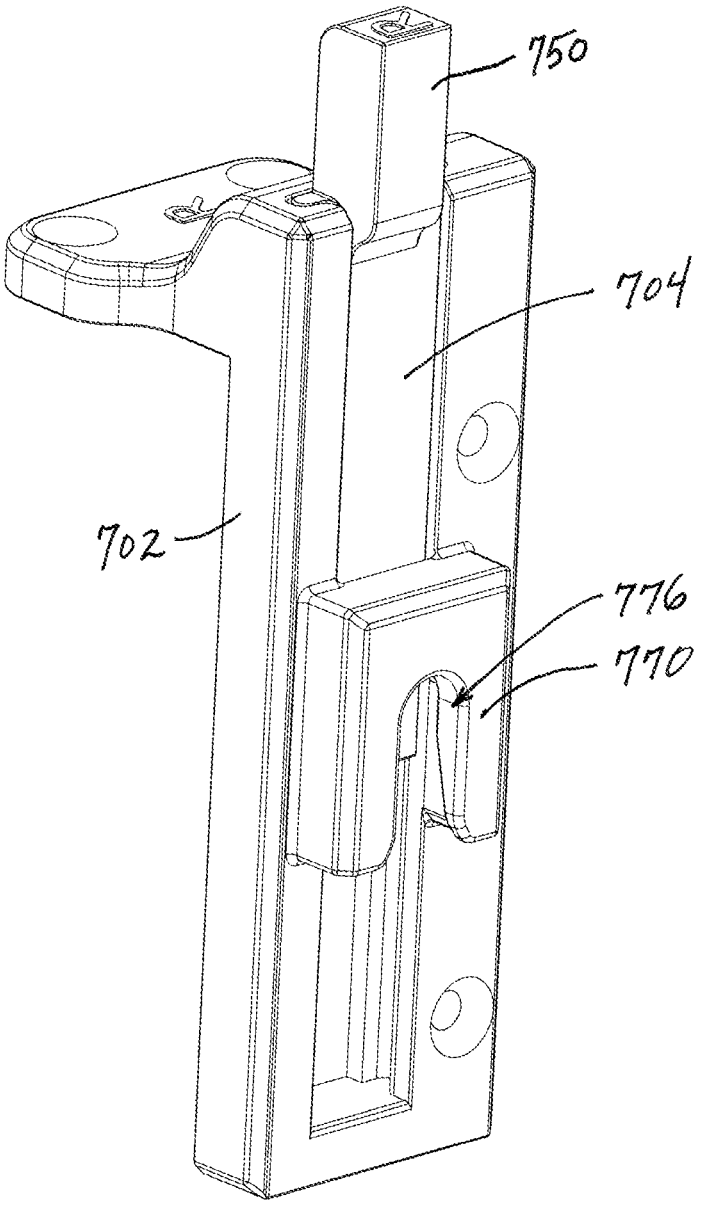
FIG. 7 is an isometric view of a shoot bolt system in accordance with another embodiment.

FIG. 7 is an isometric view of a shootbolt assembly 700 in accordance with another embodiment. With reference to FIG. 7, shootbolt assembly includes a chassis 702 and shootbolt 704 (slider) similar in structure and function to the chassis 202 and shootbolt 204 of FIGS. 2-6 but having a slightly different shape for desired strength, performance, and/or manufacturability. For example, an extended portion 750 of shootbolt 702 has a square cross section, rather than a round cross section. Chassis 702 further includes a lock keeper 770 having a U-shaped slot 776 sized to receive a movable lock pin of an adjacent moving panel of a fenestration system, to facilitate latching together two moving panels utilizing the same chassis 702 as a foundation for both the shootbolt 704 and the lock keeper 770.

A method of use of the panel system 100 may include various steps or processes. The description of the steps or processes below is not intended to be all-inclusive or to define an order of operation unless specifically stated. The method of use may include some or all of the following steps or processes described below.

The user may move the first panel 120 into the closed position and thereafter manipulate the first handle 129 to dispose the first panel 120 toward to the locked configuration and prevent the first panel 120 from moving away from the closed position when the second panel 130 is not in the closed position. The user may move the second panel 130 into contact with the first panel 120 while the first panel 120 is in the closed position and locked configuration, and couple the second panel 130 to the first panel 120 without manually moving or manually preventing movement of the first panel 120. In some embodiments, manipulation of the first handle 129 may cause the first panel 120 to move in a transverse direction, i.e., perpendicular to the first panel 120, after the first panel 120 is in the closed position, causing the first stop surface 452 to slide along the first receiver contact surface 508 in the transverse direction. Similarly, manipulation of the first handle 129 toward the unlocked configuration may cause the first stop surface 452 to slide along the first receiver contact surface 508 in the opposite transverse direction before the first panel 120 is moved away from the closed position.

The user may move the second panel 130 away from the closed position by first articulating the second handle 139 to unlatch the second panel 130 from the first panel 120 and sliding the second panel 130 away from the first panel 120. The user may then move the first panel 120 away from the closed position by first articulating the first handle 129 to unlatch the first panel 120 from the frame 110 and sliding the first panel 120 toward an open position. In some instances, the user may move the first panel 120 away from the closed position while the second panel 130 is latched to the first panel 120. In such an instance, the user may first articulate the first handle 129 and the second handle 139 to dispose each of the first panel 120 and the second panel 130 into the unlocked configuration and thereafter, slide the first panel 120 away from the second panel 130.

It will be obvious to those having skill in the art that many changes may be made to the details of the above-described embodiments without departing from the underlying principles of the invention.

The invention claimed is:

1. A panel system comprising:

a first slidable panel including:

a first stile and a first rail which meet at a first corner of the first slidable panel, the first slidable panel being slidably mountable within a frame with the first rail positioned adjacent a horizontal member of the frame, and a first outer edge of the first rail facing toward the horizontal member of the frame, such that the first slidable panel can slide horizontally within the frame along the horizontal member;

a corner drive mechanism attached to and carried by the first slidable panel, the corner drive mechanism including a first portion extending along the first stile and movable upwardly or downwardly therealong in response to an applied actuation force, and a second portion extending horizontally along the first rail and operably linked to the first portion so that the second portion is moved horizontally along the first rail in response to movement of the first portion upwardly or downwardly along the first stile;

a chassis fixedly attached directly to the first slidable panel proximate the first corner thereof, the chassis including a guideway; and a shootbolt, at least a portion of which is slidably received in the guideway, the shootbolt releasably coupled to the first portion of the corner drive mechanism for movement therewith upwardly and downwardly, relative to the first stile and the chassis, between a retracted position in which the shootbolt is recessed in the chassis, and an extended position in which the shootbolt extends beyond the chassis and outwardly beyond the first outer edge of the first rail;

a second slidable panel including a second stile and a second rail which meet at a second corner of the second slidable panel, the second slidable panel being slidably mountable within the frame with the second rail positioned adjacent the horizontal member of the frame, and a second outer edge of the second rail facing toward the horizontal member of the frame, such that the second slidable panel can slide horizontally within the frame along the horizontal member;

wherein the first slidable panel and the second slidable panel are configured to slide horizontally within the frame along the horizontal member to a closed position in which the first stile of the first slidable panel and the second stile of the second slidable panel are adjacent each other;

wherein the shootbolt is configured to retain the first slidable panel in the closed position, when the shootbolt is in the extended position, as the second slidable panel is moved into the closed position and causes contact between the first stile of the first slidable panel and the second stile of the second slidable panel.

2. The panel system of claim 1, wherein the first slidable panel includes a handle that is operatively coupled to the corner drive mechanism and manually moveable to transmit the applied actuation force to the first portion of the corner drive mechanism.

3. The panel system of claim 1, wherein the first and second portions of the corner drive mechanism constitute sections of a flexible band that extends along the first stile, around the first corner of the first slidable panel, and along the first rail, and the shootbolt is coupled to the flexible band for movement therewith between the retracted position and the extended position.

4. The panel system of claim 1, further comprising a stop attachable to the horizontal member of the frame to interfere with the shootbolt when in the extended position to thereby limit movement of the first slidable panel along the frame.

5. The panel system of claim 1, wherein the retracted position corresponds to an unlocked configuration of the panel system, and the extended position corresponds to a locked configuration of the panel system.

6. The panel system of claim 1, wherein the guideway includes a first pathway defined by parallel inward facing first surfaces and a second pathway defined by parallel inward facing second surfaces, and the shootbolt includes a first section and a second section, wherein the first section is sized to facilitate sliding engagement with the first pathway, and the second section is sized to facilitate sliding engagement with the second pathway, wherein the second surfaces are spaced apart by a distance greater than spacing between the first surfaces to thereby define an undercut slot.

7. The panel system of claim 6, wherein the guideway includes a T-slot defined by the first pathway and the second pathway.

8. The panel system of claim 1, wherein the chassis includes a vertical section in which the guideway is located.

9. The panel system of claim 8, wherein the vertical section includes one or more vertical mounting holes through which a fastener attaches the chassis directly to the first stile.

10. The panel system of claim 8, wherein the chassis further includes a horizontal section coupled to the vertical section and extending perpendicularly therefrom along the first rail, the horizontal section including one or more horizontal mounting holes through which a fastener attaches the chassis to the first rail.

11. The panel system of claim 8, wherein:

the vertical section includes an elongate opening disposed at least partially along the guideway; and the corner drive mechanism includes a pin that extends outwardly from the first portion and through the elongate opening to engage a hole in the shootbolt to operably and releasably couple the first portion to the shootbolt for co-movement.

12. The panel system of claim 1, wherein the shootbolt includes a hole and the corner drive mechanism includes a pin extending outwardly from the first portion and into the hole to operably and releasably couple the first portion of the corner drive mechanism to the shootbolt for co-movement.

13. The panel system of claim 1, wherein the first rail of the first slidable panel is a top rail and the horizontal member of the frame is a header rail.

14. The panel system of claim 1, wherein the first slidable panel includes a track that extends vertically along a second outer edge of the first stile and horizontally along the first outer edge of the first rail, and the corner drive mechanism includes a flexible band positioned in the track for movement therealong and around the first corner.

15. The panel system of claim 1, wherein the chassis includes a lock keeper having a slot sized to receive a movable lock pin of an adjacent panel.

16. A shoot bolt system for a fenestration comprising:

a corner drive mechanism attachable to a slidable panel of the fenestration that is slidable within a frame, the corner drive mechanism extendable over a corner of the slidable panel with a first portion extending along a first edge of the slidable panel and a second portion extending along a second edge of the slidable panel, the first and second edge meeting at the corner, the first portion movable along the first edge in response to an applied actuation force, the second portion extending along the second edge and operably linked to the first portion so that the second portion is moved along the second edge in response to movement of the first portion along the first edge;

a chassis attachable to the slidable panel to be fixed relative to the first edge and the second edge, the chassis including a guideway slot, the chassis including a first section in which the guideway slot is formed that includes one or more mounting holes through which a fastener is received for mounting the chassis directly to the first edge and;

a shootbolt releasably coupled to the first portion for movement relative to the first edge in response to movement of the first portion along the first edge, the shootbolt received in the guideway slot and supported for sliding movement along the guideway slot between a retracted position in which the shootbolt is recessed in the chassis, and an extended position in which the shootbolt extends from the chassis.

17. The shoot bolt system of claim 16, further comprising a receiver attachable to a frame of the fenestration, the receiver configured to engage the shootbolt in the extended position.

18. The shoot bolt system of claim 16, wherein the chassis includes an elongate opening therethrough which is disposed at least partially along the guideway slot.

19. The shoot bolt system of claim 16, wherein the chassis further includes a mounting flange coupled to the first section and extending perpendicularly therefrom, the mounting flange including one or more mounting holes through which a fastener is received for mounting the chassis to the second edge.

20. The shoot bolt system of claim 16, wherein the chassis includes a lock keeper having a slot sized to receive a movable lock pin of an adjacent panel.

* * * * *